United States Patent [19]

Davis

[11] 4,312,204

[45] Jan. 26, 1982

[54] PADDLE LOCK WITH TRANSLATABLY-MOUNTED HANDLE DISCONNECT MEMBER

[75] Inventor: Edwin W. Davis, Medina, Ohio

[73] Assignee: The Eastern Company, Cleveland, Ohio

[21] Appl. No.: 108,015

[22] Filed: Dec. 28, 1979

[51] Int. Cl.[3] ..... E05B 55/10

[52] U.S. Cl. ..... 70/472; 70/149; 70/218; 70/489; 292/167; 292/DIG. 27; 292/DIG. 31

[58] Field of Search ..... 70/472, 488, 489, 149, 70/204, 218, 208, 221–224, 416; 292/167, 173, 223, 226, DIG. 27, DIG. 31, DIG. 37

[56] References Cited

U.S. PATENT DOCUMENTS

| | | | |
|---|---|---|---|
| 5,492 | 3/1848 | Pye | 292/DIG. 27 X |
| 95,507 | 10/1869 | Petre | 292/DIG. 27 X |
| 269,953 | 1/1883 | Moritz . | |
| 528,450 | 10/1894 | Swanberg . | |
| 1,751,184 | 3/1930 | Wodarra . | |
| 1,785,381 | 12/1930 | Holtzman . | |
| 1,840,062 | 1/1932 | Taylor . | |
| 1,909,210 | 5/1933 | Miller . | |
| 1,911,564 | 5/1933 | Gahagan . | |
| 1,960,410 | 5/1933 | Christensen . | |
| 1,964,066 | 6/1934 | Kuszmaul . | |
| 2,053,805 | 9/1936 | Van Note . | |
| 2,075,948 | 4/1937 | Kuszmaul . | |
| 2,117,715 | 5/1938 | Godfried . | |
| 2,274,455 | 2/1942 | Murphy . | |
| 2,322,892 | 6/1943 | Springer . | |
| 2,453,505 | 11/1948 | Fornwald . | |
| 2,459,029 | 1/1949 | Ingres et al. . | |
| 2,468,644 | 4/1949 | Springer . | |
| 2,582,928 | 1/1952 | Dall . | |
| 2,603,963 | 7/1952 | Allen . | |
| 2,629,618 | 2/1953 | Roethel . | |
| 2,649,321 | 8/1953 | Smith . | |
| 2,658,781 | 11/1953 | Allen . | |
| 2,700,290 | 1/1955 | Dall . | |
| 2,705,882 | 4/1955 | Craig . | |
| 2,705,884 | 4/1955 | Craig . | |
| 2,723,145 | 11/1955 | Smith . | |
| 2,728,214 | 12/1955 | Craig . | |
| 2,772,908 | 12/1956 | Craig . | |
| 2,773,716 | 12/1956 | Craig . | |
| 2,782,062 | 2/1957 | Smith . | |
| 2,877,043 | 3/1959 | Leslie . | |
| 2,955,864 | 10/1960 | Van Voorhees . | |
| 2,978,895 | 4/1961 | Heisler . | |
| 2,987,907 | 6/1961 | Cockburn et al. . | |
| 3,007,731 | 11/1961 | Roethel . | |
| 3,069,889 | 12/1962 | Johnstone et al. . | |
| 3,104,124 | 9/1963 | Beck . | |
| 3,121,580 | 2/1964 | Di Salvo et al. . | |
| 3,129,026 | 4/1964 | Gergoe et al. . | |
| 3,153,551 | 10/1964 | Sandor et al. . | |
| 3,171,677 | 3/1965 | Klove, Jr. et al. . | |
| 3,309,127 | 3/1967 | Pickles . | |
| 3,314,708 | 4/1967 | Welch . | |
| 3,386,760 | 6/1968 | Bessette . | |
| 3,394,957 | 7/1968 | Foley . | |
| 3,423,117 | 1/1969 | Klove, Jr. et al. . | |
| 3,587,259 | 6/1971 | Sandor . | |
| 3,649,061 | 3/1972 | Meyer . | |
| 3,672,713 | 6/1972 | Pickles . | |
| 3,679,251 | 7/1972 | Brockman et al. . | |
| 3,695,660 | 10/1972 | Fetters . | |
| 3,695,663 | 10/1972 | Cockburn . | |
| 3,697,105 | 10/1972 | Marx . | |
| 4,116,027 | 9/1978 | Tannery | 70/472 |
| 4,170,119 | 10/1979 | Kalis, Jr. | 70/149 X |

FOREIGN PATENT DOCUMENTS

| | | | |
|---|---|---|---|
| 135399 | 9/1947 | Australia . | |
| 717308 | 2/1942 | Fed. Rep. of Germany . | |
| 232079 | 4/1925 | United Kingdom | 292/DIG. 27 |

*Primary Examiner*—William E. Lyddane
*Attorney, Agent, or Firm*—Burge & Porter Co.

[57] ABSTRACT

A door lock has a flush-mountable body. A forwardly facing recess is defined by the body. A paddle-type handle is pivotally carried by the body and is movable between a nested position within the body recess and an operating position. A spring-projected slide bolt is carried on the back of the body and is movable between projected and retracted positions. A key-controlled disconnect linkage is provided for selectively connecting and disconnecting the handle and the bolt. The disconnect linkage includes a disconnect member which is mounted for translatory movement along one side of the bolt to bring other disconnect components selectively into and out of driving engagement. A key-operated locking member moves the disconnect member between connecting and disconnecting positions. When the disconnect linkage drivingly connects the handle and the bolt, movement of the handle from its nested position to an operating position will cause corresponding retracting movement of the bolt. When the disconnect linkage disconnects the handle from the bolt, movement of the handle is inoperative to cause retracting movement of the bolt. A feature of the disconnect linkage is that it provides the lock with a "slam" capability, meaning that when the bolt is projected, it can be slammed into latching engagement with a suitably configured strike regardless of whether the disconnect linkage is drivingly connecting or disconnecting the handle and the bolt.

28 Claims, 6 Drawing Figures

PADDLE LOCK WITH TRANSLATABLY-MOUNTED HANDLE DISCONNECT MEMBER

CROSS-REFERENCE TO RELATED APPLICATIONS

PADDLE LOCKS WITH HANDLE DISCONNECT FEATURES, Ser. No. 108,007 filed concurrently herewith on Dec. 28, 1979 by John V. Pastva, Jr., hereinafer "Disconnect Case I."

PADDLE LOCK WITH PIVOTALLY MOUNTED HANDLE DISCONNECT MEMBER, Ser. No. 108,010 filed concurrently herewith on Dec. 28, 1979 by Albert L. Pelcin, hereinafter "Disconnect Case II."

PADDLE LOCK WITH BOLT-CARRIED HANDLE DISCONNECT MEMBER, Ser. No. 107,859 filed concurrently herewith on Dec. 28, 1979 by John V. Pastva, Jr. and Albert L. Pelcin, hereinafter "Disconnect Case III."

PADDLE LOCK WITH ROTATABLY-MOUNTED HANDLE DISCONNECT MEMBER, Ser. No. 108,017 filed concurrently herewith on Dec. 28, 1979 by James A. Reed and Edwin W. Davis, hereinafter "Disconnect Case IV."

PADDLE LOCK WITH HANDLE DISCONNECT, Ser. No. 108,016 filed concurrently herewith on Dec. 28, 1979 by Jye P. Swan, John V. Pastva, Jr. and Donald J. Dignan, hereinafter "Disconnect Case VI."

PADDLE LOCK WITH GUARD-PROTECTED HANDLE DISCONNECT MEMBER, Ser. No. 107,858 filed concurrently herewith on Dec. 28, 1979 by Edwin W. Davis, hereinafter "Disconnect Case VII."

FLUSH-MOUNTABLE LOCK WITH ACTUATOR DISCONNECT FEATURE, Ser. No. 108,011 filed concurrently herewith on Dec. 28, 1979 by Edwin W. Davis, hereinafter "Disconnect Case VIII."

The present application and the applications cross-referenced above have been assigned to a common entity, The Eastern Company, a corporation of Connecticut.

BACKGROUND OF THE INVENTION

1. Field of the Invention

The present invention relates generally to a flush-mountable door lock having a spring-projected slide bolt, a handle for retracting the bolt, and a key control for selectively permitting and preventing the handle from retracting the bolt. More particularly, the invention relates to a lock of this type including a key-controlled disconnect linkage for selectively drivingly connecting and disconnecting the handle and the bolt, whereby the handle is, at all times, freely movable between normal and operating positions, but is functional only when the key control is "unlocked" to enable the handle to retract the bolt.

While the present invention has particularly advantageous use in conjunction with flush-type door locks used on swinging doors of vehicles, industrial cabinets, electrical equipment enclosures and the like, principles of the invention are not limited in application to such uses.

2. Prior Art

Flush-type door locks including a body, a lock bolt slidably carried on the body, and an operating handle for moving the bolt relative to the body are well known. Normally the handle is in a flush or nested position when the bolt is projected. Bolt retraction is effected by pivoting the handle to an operating position. Locks of this type are well suited for use on swinging doors of vehicles such as trucks, on merchandise, tool and equipment cabinets, electrical equipment enclosures and the like.

Flush-type, paddle-handle door locks employing key-operated rotatable cams for selectively permitting and preventing unlocking movements of operating handles, and having spring-projected slide bolts, are described in U.S. Pat. Nos. 3,707,862, and 3,668,907 granted Jan. 2, 1973 and June 13, 1972, respectively, to John V. Pastva, Jr. An ornamental appearance employed in locks of this general type is illustrated in United States Design Pat. No. 230,132 issued Jan. 29, 1974 to John V. Pastva, Jr.

The provision of a handle disconnect feature in a door lock is desirable in that the presence of such a feature will lessen, if not totally eliminate, incidents of these locks being damaged by would-be intruders. Since the handles of most previously proposed door locks are restrained from moving when the locks are locked, it is common for would-be intruders to attempt to gain entry by applying excessive leverage force to the lock handles. Where handle disconnect features are provided, the lock handles may always be moved freely, but are functional to retract the lock bolts only when the locks are "unlocked." Locks having handle disconnect features can be made practically entry-proof short of the application of such forces as will totally destroy the locks.

Door locks employing various types of handle disconnect systems have been proposed. Prior proposals have, however, suffered from a variety of drawbacks including complexities of construction; failures to mount all of the operating parts of a lock on a single body member so that the resulting locks form compact, easy to install units; and, inappropriately configured parts of sizes and shapes that prohibit installation of locks embodying such proposals in conventionally configured door lock mounting openings.

3. The Cross-Referenced Disconnect Cases

The present invention and the inventions described in the several referenced Disconnect Cases represent the work products of a continuous and continuing development program which began nearly a decade ago.

The several handle disconnect systems described in the referenced Disconnect Cases were developed by co-workers operating, in some instances independently, and in other instances jointly, as is reflected in the naming of sole and joint inventors. Many of the disconnect system features claimed in separate ones of the referenced Disconnect Cases were developed substantially concurrently.

Where a claim in one of the referenced Disconnect Cases is found to be generic to a development concept utilized in another of these cases, it should be understood that care has been taken to present the generic claim in the case which describes the earliest development of a species that will support the generic claim. In this manner, a careful effort has been made to establish clear lines of demarcation among the claimed subjects matter of this and the several referenced Disconnect Cases. No two of these patents include claims of identical scope.

SUMMARY OF THE INVENTION

The present invention overcomes the foregoing and other drawbacks of the prior proposals by providing a novel and improved, reliable and durable, handle-operated door lock which includes a simple but effective key-controlled disconnect linkage for selectively drivingly interconnecting and disconnecting an operating handle and a spring-projected slide bolt.

A door lock embodying principles of the present invention preferably includes a support structure or body having side and back walls which cooperate to define a forwardly-facing recess. A bolt is slidably supported on the body for movement within a passage located behind the back wall. The bolt is movable between projected and retracted positions with respect to the body, and a compression coil spring biases the bolt toward its projected position. A handle is supported on the body for swinging movement between a nested position and an operating position.

A key-controlled disconnect linkage has a locking member which is movable between locked and unlocked positions. An elongate disconnect member lies alongside the bolt and is translated along the bolt by the locking member between positions wherein the disconnect member trips other disconnect components to selectively drivingly connect and disconnect the handle and the bolt. When the locking member is in its locked position, the disconnect member disconnects the handle and the bolt such that movement of the handle will not cause movement of the bolt. When the locking member is in its unlocked position, the disconnect member is operable to drivingly connect the handle and the bolt such that, when the handle is moved out of its nested position to an operating position, the bolt is retracted.

The disconnect linkage includes several improvements over previously proposed handle disconnect systems. It includes a disconnect member of relatively simple-to-form, essentially flat configuration which extends longitudinally alongside the bolt. One end region of the disconnect member is engageable with other disconnect components carried within the slide bolt passage and serves to position these other components so that they selectively drivingly connect and disconnect the handle and the bolt. The other end region of the disconnect member is engaged by a key-operated locking member which is operable to move the disconnect member between its connecting and disconnecting positions.

A feature of locks embodying the preferred practice of the present invention is that conventional lock bodies and handles may be utilized thereby giving these locks substantially the same dimensional configurations as previously proposed locks which had no handle disconnect features. Moreover, since the disconnect functions of these locks are carried out principally at shielded locations within their slide bolt housings, the locks are not notably different in appearance from previously proposed paddle locks which had no handle disconnect features.

As will be apparent from the foregoing summary, a feature of the present invention lies in the provision of a novel and improved door lock with a key-controlled disconnect system for selectively drivingly connecting and disconnecting the handle and the bolt.

These and other features and a fuller understanding of the present invention may be had by referring to the following detailed description and claims taken in conjunction with the accompanying drawings.

DESCRIPTION OF THE PREFERRED EMBODIMENT

Figure 1:
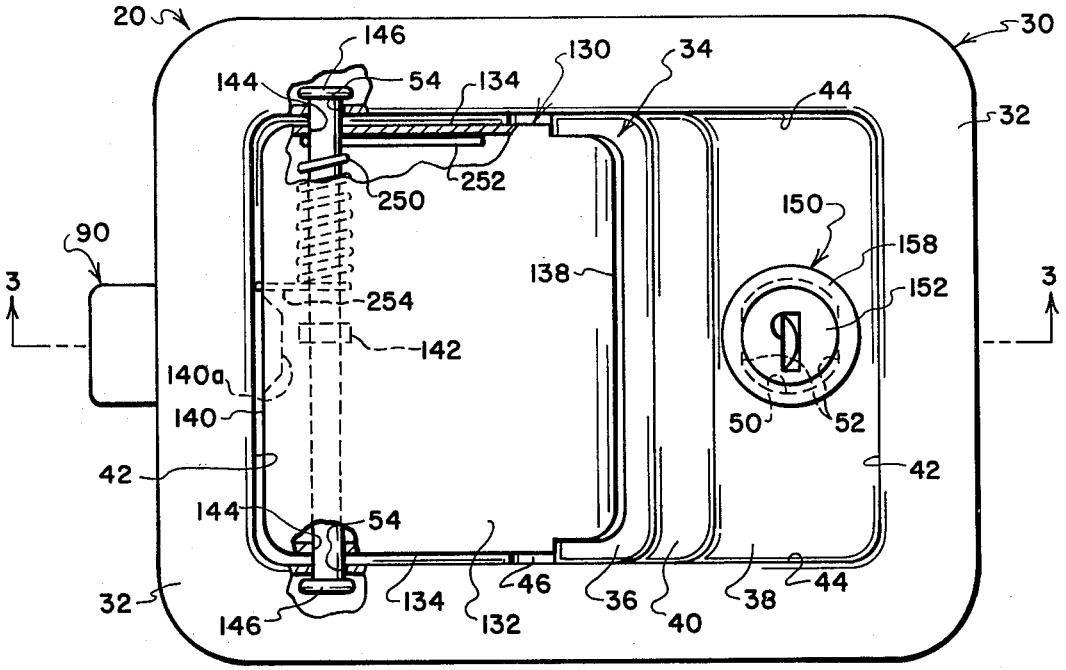
FIG. 1 is a front side elevational view of a lock embodying the present invention with portions broken away to permit underlying components to be viewed, the components of the lock being positioned in a locked attitude, with the handle nested and the bolt projected.
Figure 2:
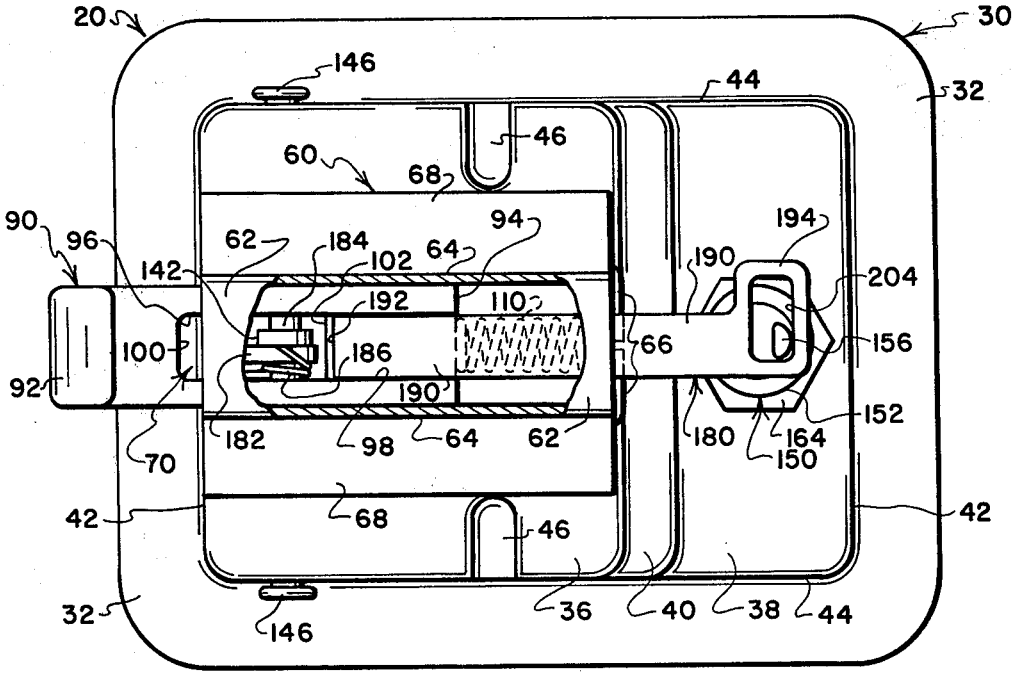
FIG. 2 is a rear side elevational view of the lock of FIG. 1 with the components of the lock positioned as shown in FIG. 1, and with a portion of the lock bolt housing broken away to permit underlying components to be viewed.

Referring to FIGS. 1–6, a key-controlled, paddle-handle, flush-mountable lock embodying the preferred practice of the present invention is indicated generally by the numeral 20. The lock 20 is adapted to be supported on such structures as a swinging door (not shown) for relative movement therewith to bring the lock 20 into and out of juxtaposition with a suitably configured strike (not shown) supported on a door frame or other structure (not shown). The manner in which locks of this general type are mounted on doors is well known to those skilled in the art. The mounting of such locks is described and illustrated in such patents as Pastva, Jr., U.S. Pat. No. 3,668,907.

In general, the lock 20 includes a recessed body 30 having a bolt housing 60 welded to the rear side of the body 30. The bolt housing 60 and the back wall of the body 30 cooperate to define an elongate passage 70. A bolt 90 is slidably carried in the passage 70 for movement between retracted and projected positions. A compression coil spring 110 biases the bolt 90 toward its projected position. A paddle handle 130 is pivotally carried on the body 30 for movement between nested and operating positions. A key control 150, a disconnect member 180, and a pair of disconnect components 142, 182, are provided for selectively drivingly connecting and disconnecting the handle 130 and the bolt 90. A handle return spring 250 biases the handle 130 toward its nested position.

The body 30 is a rectangular, pan-shaped metal stamping having a perimetrically extending flange 32 which surrounds a forwardly facing recess 34. Left and right back wall portions 36, 38 define levels of different depths in opposite end portions of the recess 34. An inclined back wall portion 40 interconnects the left and right back wall portions 36, 38. Forwardly extending end walls 42 and side walls 44 connect the back wall portions 36, 38, 40 with the flange 32.

Other features of the body 30 include a pair of stops 46 formed in the left back wall portion 36. The stops 46 project into the recess 34 at locations near the side walls 44, and are engaged by the handle 130 when the handle 130 is in its nested position. An elongate slot 48 is provided in the left back wall portion 36 at a location overlying the bolt 90. A hole 50 is formed through the right back wall portion 38. Opposite sides of the hole 50 have flat, parallel-extending surfaces 52. Aligned holes 54 are formed through the side walls 44 near their left ends.

The bolt housing 60 is a channel-shaped sheet metal stamping having a bottom wall 62, a pair of opposed side walls 64, an end wall 66, and a pair of mounting flanges 68. The flanges 68 overlie and are welded to the rear side of the left back wall portion 36.

Figure 4:
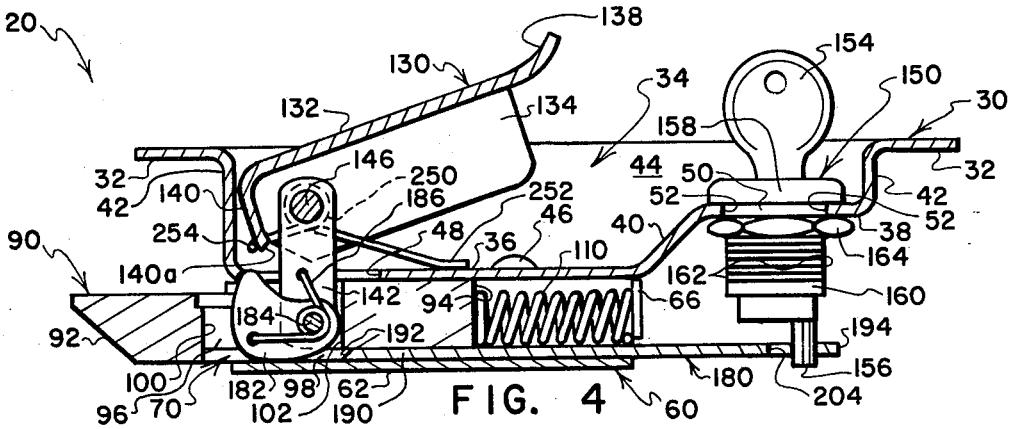
FIG. 4 is a sectional view similar to FIG. 3 with the components of the lock being positioned in a locked attitude, with the handle extended to an operating position and with the bolt nonetheless still in its projected position.

The bolt housing 60 cooperates with the left back wall portion 36 to define the passage 70 within which the bolt 90 is guided for sliding movement. The end wall 66 is formed in two parts as integral, inwardly turned extensions of the side walls 64, and operates to close a majority of the area of the right end of the bolt passage 70. As is best seen in FIGS. 4 and 6, the end wall 66 stops short of the bottom wall 62, permitting the disconnect member 180 to be slidably carried therebetween.

The bolt 90 is a solid metal member which can be formed by conventional casting or powder metallurgy techniques. The bolt 90 has a generally rectangular cross section which corresponds to that of the passage 70. The bolt 90 has a tapered left end 92 configured, as is conventional, to permit the bolt 90 to be retracted in response to slamming engagement with a suitably configured strike (not shown). The bolt 90 has a flat right end 94. The bolt 90 has a receiving formation which preferably takes the form of an elongate slot 96 provided in the central part of the bolt 90. The bolt slot 96 has left and right end walls 100, 102 at its opposite ends. A recess 98 extends in the back side of the bolt 90 from the right end 102 of the slot 96 to the right end 94 of the bolt 90. The disconnect member 180 is slidably carried in the recess 98.

Figure 5:
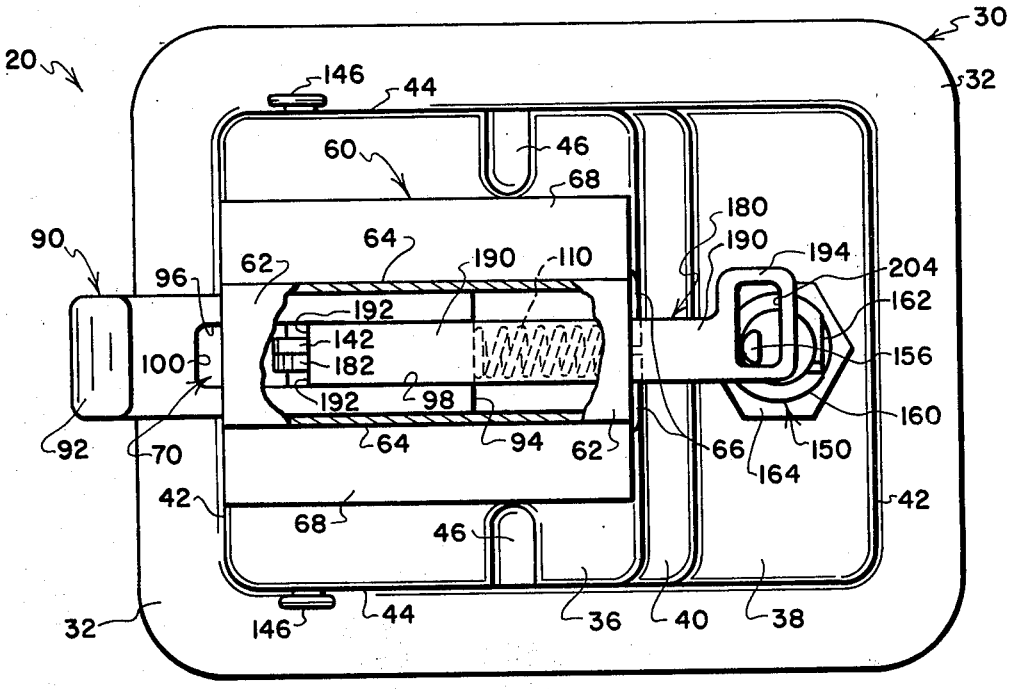
FIG. 5 is a rear side elevational view similar to FIG. 2 with portions of the bolt housing broken away, with the components of the lock positioned in an unlocked attitude, with the handle nested and the bolt projected; and, FIG. 6 is a sectional view similar to FIG. 4 with the components of the lock being positioned in an unlocked attitude, with the handle extended to an operating position, and with the bolt retracted.
Figure 6:
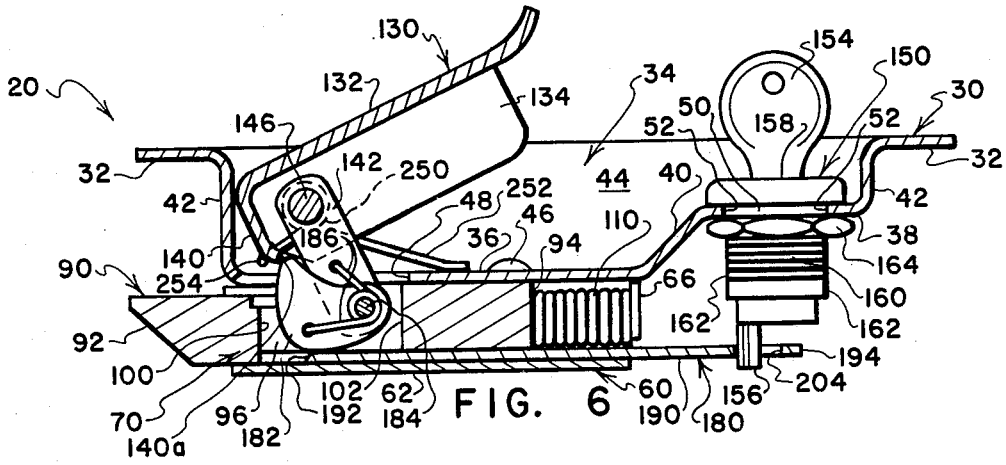

The bolt 90 is movable between a projected position, shown in FIGS. 1–5, and a retracted position shown in FIG. 6. When the bolt 90 is projected, its tapered left end 92 extends beyond the left edge of the body flange 32. When the bolt 90 is retracted, its tapered left end 92 extends substantially evenly with the left edge of the body flange 32.

The compression coil spring 110 is positioned in the passage 70. The spring 110 has a left end which engages the bolt end 94, and a right end which engages the bolt housing end wall 66. The spring 110 biases the bolt 90 leftwardly toward its projected position, and is compressed to progressively greater degrees as the bolt 90 is retracted.

The paddle handle 130 is a sheet metal stamping having a generally rectangular, substantially flat plate portion 132 and a pair of opposed, inwardly-turned side flanges 134. An outwardly-turned gripping flange 138 is provided at the right end of the handle 130, and an inwardly-turned operating flange 140 is provided at the left end. An abutment surface **140*a* is provided on a depending inwardly turned part of the handle flange 140**.

The handle 130 has aligned mounting holes 144 formed through its side flanges 134. A headed pin 146 extends through the body holes 54 and through the handle mounting holes 144 to pivotally mount the handle 130 on the body 30 at a location between the body side walls 44.

When the handle 130 is in its normal nested position, as shown in FIGS. 1–3 and 5, the spring 110 biases the bolt 90 leftwardly to its extended or latched position. At the same time, the handle return spring 250 biases the handle 130 clockwise, as viewed in FIG. 3, to maintain the handle side flanges 134 in engagement with the bottom wall stops 46.

When the handle 130 is moved out of its nested position to an operating position by pivoting it counterclockwise, about the axis of the pin 146, as viewed in FIGS. 4 and 6, the bolt 90 will be retracted in opposition to the action of the spring 110 only if the disconnect member 180 is positioned in what will be termed its "connecting" position. In FIGS. 5 and 6, the disconnect member 180 is in its connecting position wherein it positions the disconnect components 142, 182 to provide a driving connection between the handle 130 and the bolt 90. When the disconnect member 180 is in its connecting position, the bolt 90 is caused to retract rightwardly in the passage 70 as the handle 130 pivots out of its nested position, as is shown in FIG. 6. In FIGS. 1–4, the disconnect member 180 is in its disconnecting position. When the disconnect member 180 is in its disconnecting position, it positions the disconnect components 142, 182 to provide no driving connection between the handle 130 and the bolt 90 whereby, when the handle 130 is pivoted about the axis of the pin 146, no corresponding movement of the bolt 90 takes place, as is illustrated in FIG. 4.

The disconnect components 142, 182 are pivotally connected to each other by a pin 184 which extends through aligned holes formed in overlapping parts of the components 142, 182. A torsion coil spring 186 has a central portion reeved around the pin 184, and opposite end portions which connect with separate ones of the components 142, 182. The spring 186 biases the component 182 counterclockwise relative to the component 142 as viewed in FIGS. 3, 4 and 6, or, stated in another way, the spring 186 biases the component 142 clockwise relative to the component 182.

The component 142 is pivotally mounted on the pin 146 and depends through the body slot 48 and into the bolt slot 96. The components 141, 182 are relatively loosely positioned within the bolt slot 96 and are normally spaced from both left and right end surfaces 100, 102, of the slot 96. The spacing between the slot end surfaces 100, 102 and the pivotal mounting of the component 142 permits the bolt 90 to be retracted, i.e. moved rightwardly in the passage 70, without requiring corresponding pivotal movement of the handle 130. This feature is desirable because it provides a lost motion connection which gives the lock 20 a capability to be "slammed" to bring the bolt 90 into latching engagement with a suitably configured strike (not shown) without causing the handle 130 to pivot out of its nested position.

The key control 150 includes a lock cylinder 152 into which a key 154 may be inserted. The key 154 is configured to cooperate with tumblers housed within the cylinder 152 to permit a locking member 156 to be rotated between locked and unlocked positions. The locked position of the locking member 156 is shown in FIGS. 1-4. The unlocked position of the locking member 156 is shown in FIGS. 5 and 6.

The cylinder 152 is provided with an enlarged head 158 and a threaded body 160. A pair of flats 162 are formed on opposite sides of the threaded body 160. The cylinder 152 is positioned with its head 158 engaging the forward surface of the right body portion 38, with its body 160 extending through the hole 50, and with its flats 162 engaging the flat surfaces 52. A locknut 164 is threaded onto the body 160 to hold the cylinder 152 in place on the lock body 30.

While the key control 150 is of a conventional, commercially available type, it is selected from among various commercially available key controls which have particular operational characteristics. These operational characteristics should include key removal capability when the locking member 156 is positioned in either of its locked and unlocked positions. A further characteristic of the key control 150 is that, once the locking member 156 has been positioned in either of its locked or unlocked positions and the key 154 has been removed from the cylinder 152, the key control 150 maintains the locking member 156 in such position.

The disconnect member 180 has an elongate, flat central section 190 which terminates in a pointed left end 192 and an enlarged right end formation 194. The central portion 190 is slidably received between the bolt housing bottom and end walls 62, 66, and extends through the bolt recess 98. The left end 192 lies below the bolt slot 96. The right end 194 extends toward the key control 150. An elongate, laterally extending slot 204 is formed in the right end formation 194. The locking member 156 extends into the slot 204.

When the locking member 156 is in its unlocked position as shown in FIGS. 5 and 6, the locking member 156 engages disconnect member 180 and shifts its longitudinally within the bolt passage 70 to a connecting position where, as is best seen in FIG. 6, the left end 192 pivots the disconnect component 182 into engagement with the abutment surface 140*a* to provide a driving connection between the handle 130 and the bolt 90. When the disconnect member 180 assumes its connecting position, as shown in FIG. 5, pivotal movement of the handle 130 from its nested position, shown in FIG. 1, to its operating position, shown in FIG. 6, will cause the disconnect components 142, 182 to pivot rightwardly about the axis of the pin 146, carrying with them the bolt 90. Stated in another way, when the locking member 156 is in its unlocked position as shown in FIGS. 5 and 6, the disconnect member 180 is positioned such that a driving connection is established between the handle 130 and the bolt 90. Under these circumstances, movement of the handle 130 to its operating position will cause corresponding retracting movement of the bolt 90, as is illustrated in FIGS. 6 and 7.

Figure 3:
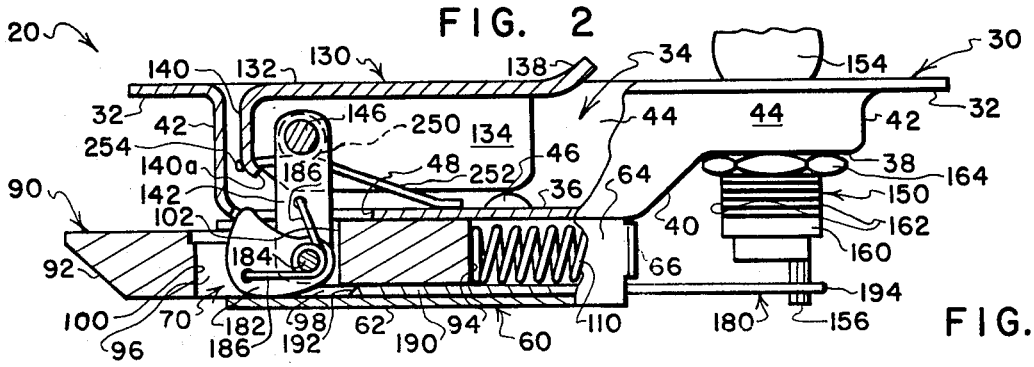
FIG. 3 is a bottom plan view with portions broken away and shown in cross-section as seen from a plane indicated by a line 3—3 in FIG. 1, with the components of the lock positioned as shown in FIG. 1.

When the locking member 156 is in its locked position, as shown in FIGS. 1-4, it translates the disconnect member 180 longitudinally with respect to the bolt passage 70 to a position where, as is best seen in FIG. 3, the left end 192 is out of engagement with the disconnect component 182, whereby the spring 186 pivots the component 182 counterclockwise to the position shown in FIG. 3, and no driving connection is provided between the disconnect member 180 and the bolt 90. When the disconnect member 180 is in its disconnecting position, pivotal movement of the handle 130 from its nested position to its operating position will cause no corresponding retraction of the bolt 90, as is shown in FIG. 4. Stated in another way, when the locking member 156 is in its locked position as shown in FIG. 8, the disconnect member 180 is positioned such that no driving connection is established between the handle 130 and the bolt 90. Under these circumstances, the handle 130 can be moved freely without causing any corresponding movement of the bolt 90.

Regardless of whether the disconnect member 180 is in its connecting or disconnecting position, if the tapered end 92 of the bolt 90 is slammed into engagement with a suitably configured strike (not shown), the bolt 90 will move rightwardly within the passage 70. During this movement, the slot end wall 100 will engage the disconnect components to pivot counterclockwise about the axis of the pin 146, and no significant force will be imposed on the disconnect member 180, nor will any significant force be transmitted to the locking member 156. The spacing between the components 142, 182 and the ends of the slot 96, together with the capability of the components 142, 182 to pivot about the axis of the pin 146 provides a lost motion connection which enables the bolt 90 to move without causing corresponding movement of the handle 130.

Referring to FIG. 3, the normal extended positions of the bolt projection spring 110 is shown. Referring to FIG. 6, when the handle 130 is extended with the lock 20 "unlocked," the bolt projection spring 110 is compressed. Referring to FIG. 4, when the handle 130 is extended with the lock 20 "locked," the bolt projection spring 110 remains in its extended attitude.

Referring to FIGS. 1, 3, 4 and 6, the handle return spring 250 is a torsion coil spring having its main body portion reeved around the pin 146. The spring 250 has one end 252 which engages the bottom wall portion 36, and another end 254 which connects with the inturned handle flange 140. The spring 250 biases the handle 130 toward a position where the handle side flanges 136 engage the back wall stops 46.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A door lock, comprising:

(a) a body structure;

(b) a bolt structure connected to the body structure for movement between latching and unlatching positions, the bolt structure having a connecting formation connected thereto for movement along a first path of travel relative to the body structure in response to movement of the bolt structure between its latching and unlatching positions;

(c) a handle structure connected to the body structure for movement between normal and operating positions, the handle structure having an operating formation connected thereto for movement along a second path of travel relative to the body structure in response to movement of the handle structure between its normal and operating positions;

(d) key control means connected to a selected one of the structures and having a locking member which is movable relative to the selected structure between locked and unlocked positions, the key control means being operable to selectively retain the locking member in its locked and unlocked positions;

(e) disconnect means interposed between the operating formation and the connecting formation for selectively drivingly connecting and disconnecting the operating and connecting formations to thereby selectively drivingly connect and disconnect the handle and bolt structures, the disconnect means including:

(i) first and second parts;

(ii) first mounting means connecting the first part of the disconnect means to a given one of the structures for movement along a third path of travel relative to the given structure between connecting and disconnecting positions in response to movement of the locking member between its locked and unlocked positions;

(iii) second mounting means connecting the second part of the disconnect means to a chosen one of the structures for movement, when the first part of the disconnect means is in its connecting position, along a fourth path of travel relative to the body structure in response to movement of the operating formation along the second path of travel;

(iv) the second part of the disconnect means including first and second pivotally connected components, the first component being pivotally connected to said chosen structure, the second component being pivotally connected to the first component; and, (v) the first part of the disconnect means being operable to position the second component into and out of driving engagement with a selected one of the formations in response to positioning of the first part in its connecting and disconnecting positions; and (f) the disconnect means being operable:

(i) when the first part of the disconnect means is in its connecting position, to drivingly connect the handle and bolt structures such that, when the handle structure is moved to its operating position, the bolt structure is caused to move to its unlatching position; and, (ii) when the first part of the disconnect means is in its disconnecting position, to provide no driving connection between the handle and bolt structures, whereby the handle structure may be moved freely between its normal and operating positions without causing corresponding movement of the bolt structure.

2. The door lock of claim 1 wherein the first mounting means is operable to translatably mount the first part of the disconnect means on the body structure for movement along a linear third path of travel, and the second mounting means is operable to pivotally mount the second part of the disconnect means on the body structure for movement along a curved fourth path of travel.

3. The door lock of claim 2 wherein the body structure includes a first housing member having wall portions including a back wall portion which cooperate to define a forwardly-facing recess, and a second housing member rigidly connected to the first housing member and cooperating therewith to define a passage within which portions of the bolt structure and the disconnect means are positioned for movement relative to the body structure.

4. The door lock of claim 1 wherein:

(a) the body structure has front and rear sides separated by a back wall portion; and, (b) the disconnect means includes a disconnect member extending in spaced parallel relationship along the rear side of the back wall portion for movement relative to the body structure.

5. The door lock of claim 1 wherein structure defining a lost motion connection connects the operating formation and the bolt structure for enabling the bolt structure to be moved from its latching position to its unlatching position without causing corresponding movement of the operating formation.

6. The door lock of claim 1 wherein the connecting formation includes an abutment surface formed on the bolt structure.

7. The door lock of claim 6 wherein the abutment surface comprises an end wall of an elongate slot formed in the bolt structure.

8. The door lock of claim 1 wherein the operating formation includes an abutment surface formed on the handle structure.

9. The door lock of claim 1 wherein:

(a) the handle structure is mounted on the body structure for pivotal movement about a mounting axis; and, (b) the operating formation is connected to the handle structure for pivotal movement about the mounting axis.

10. The door lock of claim 9 wherein:

(a) a shaft is journaled in aligned holes formed through spaced portions of the body structure, and the axis of the aligned holes defines the mounting axis;

(b) the shaft defines at least a part of the second mounting means and pivotally mounts the second part of the disconnect means; and, (c) the operating formation is an abutment surface formed on the handle structure and being engageable with the second part of the disconnect means.

11. The door lock of claim 1 wherein the key control means is mounted on the body structure.

12. The door lock of claim 1 wherein the bolt structure comprises an elongate member mounted on the body structure for sliding movement relative to the body along a linear first path of travel extending longitudinally of the elongate member.

13. The door lock of claim 1 wherein the operating formation is pivotally mounted on the body structure for movement along an arcuate second path of travel.

14. A door lock, comprising:

(a) a body structure;

(b) a bolt structure connected to the body structure for movement between latching and unlatching positions, the bolt structure having a connecting formation connected thereto for movement along a first path of travel relative to the body structure in response to movement of the bolt structure between its latching and unlatching positions;

(c) a handle structure connected to the body structure for movement between normal and operating positions, the handle structure having an operating formation connected thereto for movement along a second path of travel relative to the body structure in response to movement of the handle structure between its normal and operating positions;

(d) key control means connected to a selected one of the structures and having a locking member which is movable relative to the selected structure between locked and unlocked positions, the key control means being operable to selectively retain the locking member in its locked and unlocked positions;

(e) disconnect means interposed between the operating formation and the connecting formation for selectively drivingly connecting and disconnecting the operating and connecting formations to thereby selectively drivingly connect and disconnect the handle and bolt structures, the disconnect means including:

(i) first mounting means connecting a first part of the disconnect means to a given one of the structures for movement along a third path of travel relative to the given structure between connecting and disconnecting positions in response to movement of the locking member between its locked and unlocked positions; and, (ii) second mounting means connecting a second part of the disconnect means to a chosen one of the structures for movement, when the first part of the disconnect means is in its connecting position, along a fourth path of travel relative to the body structure in response to movement of the operating formation along the second path of travel;

(f) the disconnect means being operable:

(i) when the first part of the disconnect means is in its connecting position, to drivingly connect the handle and bolt structures such that, when the handle structure is moved to its operating position, the bolt structure is caused to move to its unlatching position;

(ii) when the first part of the disconnect means is in its disconnecting position, to provide no driving connection between the handle and bolt structures, whereby the handle structure may be moved freely between its normal and operating positions without causing corresponding movement of the bolt structure;

(g) the handle structure being mounted on the body structure for pivotal movement about a mounting axis;

(h) the operating formation being connected to the handle structure for pivotal movement about the mounting axis;

(i) a shaft being journaled in aligned holes formed through spaced portions of the body structure, and the axis of the aligned holes defining the mounting axis;

(j) the shaft defining at least a part of the second mounting means and pivotally mounting the second part of the disconnect means;

(k) the operating formation including an abutment surface formed on the handle structure and being engageable with the second part of the disconnect means;

(l) the second part of the disconnect means including first and second pivotally connected components, the first component being pivotally mounted on the shaft, the second component being pivotally mounted on the first component; and, (m) the first part of the disconnect means being operable to position the second component into and out of driving engagement with the abutment surface formed on the handle structure.

15. A door lock, comprising:

(a) a body structure;

(b) a bolt structure connected to the body structure for movement between latching and unlatching positions, the bolt structure having a connecting formation connected thereto for movement along a first path of travel relative to the body structure in response to movement of the bolt structure between its latching and unlatching positions;

(c) a handle structure connected to the body structure for movement between normal and operating positions, the handle structure having an operating formation connected thereto for movement along second path of travel relative to the body structure in response to movement of the handle structure between its normal and operating positions;

(d) key control means connected to a selected one of the structures and having a locking member which is movable relative to the selected structure between locked and unlocked positions, the key control means being operable to selectively retain the locking member in its locked and unlocked positions;

(e) disconnect means interposed between the operating formation and the connecting formation for selectively drivingly connecting and disconnecting the operating and connecting formations to thereby selectively drivingly connect and disconnect the handle and bolt structures, the disconnect means including:

(i) first mounting means connecting a first part of the disconnect means to a given one of the structures for movement along a third path of travel relative to the given structure between connecting and disconnecting positions in response to movement of the locking member between its locked and unlocked positions; and, (ii) second mounting means connecting a second part of the disconnect means to a chosen one of the structures for movement, when the first part of the disconnect means is in its connecting position, along a fourth path of travel relative to the body structure in response to movement of the operating formation along the second path of travel;

(f) the disconnect means being operable:

(i) when the first part of the disconnect means is in its connecting position, to drivingly connect the handle and bolt structures such that, when the handle structure is moved to its operating position, the bolt structure is caused to move to its unlatching position; and, (ii) when the first part of the disconnect means is in its disconnecting position, to provide no driving connection between the handle and bolt structures, whereby the handle structure may be moved freely between its normal and operating positions without causing corresponding movement of the bolt structure;

(g) the first part of the disconnect means including a disconnect member which is slidably mounted on the body structure; and, (l) the second part of the disconnect means including an operating member which is pivotally mounted on the body structure.

16. The door lock of claim 15 wherein the second part of the disconnect means additionally includes a component which is pivotally mounted on the operating member, and the first part of the disconnect means is operable to selectively position the component into and out of driving engagement with the operating formation as the first part of the disconnect means moves between its connecting and disconnecting positions.

17. A door lock, comprising:

(a) a body structure;

(b) a bolt structure connected to the body structure for movement between latching and unlatching positions, the bolt structure having a connecting formation connected thereto for movement along a first path of travel as the bolt structure moves between its latching and unlatching positions;

(c) a handle structure connected to the body structure for movement between normal and operating positions, the handle structure having an operating formation connected thereto for movement along a second path of travel as the handle structure moves between its normal and operating positions;

(d) disconnect means interposed between the connecting formation and the operating formation, the disconnect means including first and second parts, the first part of the disconnect means being movable along a third path of travel into and out of intersection with a selected one of the first and second paths of travel as the second part of the disconnect means moves between connecting and disconnecting positions, the first part of the disconnect means being operable:

(i) when the second part of the disconnect means is in its connecting position, to cooperate with the connecting and operating formations to drivingly connect the handle and bolt structures such that, when the handle structure is moved to its operating position, the bolt structure is caused to move to its unlatching position; and, (ii) when the second part of the disconnect means is in its disconnecting position, to provide no driving connection between the handle and bolt structures;

(e) the first part of the disconnect means including an operating member which is pivotally mounted on the body structure;

(f) the second part of the disconnect means including a disconnect member which is slidably mounted on the body structure; and, (g) key-control means connected to one of the structures and being operable to move the second part of the disconnect means between its connecting and disconnecting positions and to selectively releasably retain the second part of the disconnect means in its connecting and disconnecting positions.

18. The door lock of claim 17 additionally including first guide means for pivotally mounting the first part of the disconnect means on the body structure.

19. The door lock of claim 17 additionally including second guide means for mounting the second part of the disconnect means for translatory movement along a third path of travel as the second part of the disconnect means moves between its connecting and disconnecting positions.

20. The door lock of claim 17 wherein the second path of travel is curved along its length.

21. The door lock of claim 17 wherein:

(a) a first abutment surface is defined on the operating formation;

(b) a second abutment surface is defined on the first part of the disconnect means; and, (c) the first and second abutment surfaces are configured to drivingly engage each other when (i) the second part of the disconnect member means is positioned in its connecting position and (ii) the handle structure is moved from its normal position to its operating position.

22. A door lock, comprising:

(a) a body structure;

(b) a bolt structure connected to the body structure for movement along a first path of travel between latching and unlatching positions;

(c) a handle structure connected to the body structure for movement between normal and operating positions;

(d) an operating formation connected to the handle for movement in response to movement of the handle structure between its normal and operating positions, the movement of the operating formation following a second path of travel;

(e) disconnect means interposed between the operating formation and the bolt structure, and having a disconnect member which is movable along a third path of travel between connecting and disconnecting positions, and having component means which is movable by the disconnect member into and out of at least one of the first and second paths of travel, the component means being operable:

(i) when the disconnect member is in its connecting position to intersect the first and second paths of travel to drivingly connect the handle structure and the bolt such that, when the handle is moved to its operating position, the bolt structure is caused to move to its unlatched position; and, (ii) when the disconnect member is in its disconnecting position, to withdraw from intersection with at least one of the first and second paths of travel to provide no driving connection between the handle and bolt structures;

(f) key-control means connected to one of the structures and including a locking member movable between locked and unlocked positions, the key-control means being operable:

(i) when the locking member is moved to its unlocked position, to move the disconnect member to its connecting position; and, (ii) when the locking member is moved to its locked position, to move the disconnect member to its disconnecting position; and (g) guide means for:

(i) mounting the disconnect member on the body structure for sliding movement along the third path of travel as the disconnect member moves between its connecting and disconnecting positions; and, (ii) mounting at least a part of the component means on the body structure for pivotal movement along a fourth path of travel in response to movement of the operation formation along the first path of travel when the disconnect member is in its connecting position.

23. The door lock of claim 22 wherein structure defining a lost motion connection connects the disconnect means and the bolt structure for enabling the bolt structure to be moved from its latching position to its unlatching position without causing corresponding movement of the disconnect means.

24. A flush-mountable door lock, comprising:

(a) a body structure having side and back walls which cooperate to define a forwardly-facing recess, and having an opening formed through the back wall;

(b) an elongate bolt structure slidably supported on the body structure at a position behind a portion of the back wall, the bolt structure being movable between a projected position wherein the bolt structure is extended with respect to the body structure, and a retracted position wherein the bolt structure is retracted with respect to the body structure, the bolt structure having a receiving formation communicating with the back wall opening;

(c) a handle mounted on the body structure and being movable between a nested position wherein the handle is nested within the recess, and an operating position;

(d) key-control means carried by the body structure and a locking member movable between locked and unlocked positions;

(e) connecting means carried by the handle and being movable therewith, the connecting means extending through the back wall opening and into the receiving formation of the bolt structure;

(f) disconnect linkage means having a first portion pivotally mounted on the body structure and extending into the receiving formation for engaging the connecting means and having a second portion slidably carried by the body structure and extending longitudinally of the bolt structure toward the key-control means, the disconnect linkage means being movable between a connecting position wherein it is operable to drivingly interconnect the handle and bolt structures such that when the handle structure is moved out of its nested position the bolt structure is caused to retract, and a disconnecting position wherein no driving connection is provided between the handle and bolt structures; and, (g) the locking member being engageable with the second portion of the disconnect linkage means for moving the disconnect linkage means to its connecting position when the locking member is moved to its unlocked position, and for moving the disconnect linkage means to its disconnecting position when the locking member is moved to its locked position.

25. The door lock of claim 24 wherein the bolt structure is slidably mounted on the body structure.

26. The door lock of claim 24 wherein the key-control means is mounted on the body structure.

27. The door lock of claim 24 wherein the locking member is rotatably mounted for movement between its locked and unlocked positions.

28. The door lock of claim 27 wherein the key-control means is mounted on the body structure and has a rotatable cylinder which supports the locking member for rotation.

* * * * *